US005826395A

United States Patent [19]

Weaver

[11] Patent Number: 5,826,395

[45] Date of Patent: Oct. 27, 1998

[54] CONCRETE BLOCK WITH OFFSET LEDGE AND INSTALLATION GUIDE MEANS

[76] Inventor: Elvin W. Weaver, 225B North King St., Denver, Pa. 17517

[21] Appl. No.: 895,668

[22] Filed: Jul. 17, 1997

[51] Int. Cl.[6] ..... E04C 2/04

[52] U.S. Cl. ..... 52/606; 52/105; 52/283; 52/284; 52/293.2; 52/605; 52/608; 52/609

[58] Field of Search ..... 52/605, 606, 608, 52/609, 283, 284, 293.2, 105

[56] References Cited

U.S. PATENT DOCUMENTS

| | | | |
|---|---|---|---|
| 131,191 | 10/1872 | Reynolds . | |
| 300,521 | 6/1884 | Smith . | |
| 945,439 | 1/1910 | Beidler . | |
| 971,159 | 9/1910 | Stanway | 52/605 |
| 1,649,780 | 11/1927 | Robbins . | |
| 2,057,462 | 10/1936 | Weaver . | |
| 2,214,657 | 9/1940 | Brown . | |
| 2,513,711 | 7/1950 | Cain . | |
| 3,034,254 | 5/1962 | Christiansen | 52/284 X |
| 5,511,350 | 4/1996 | Nivens | 52/609 X |
| 5,560,172 | 10/1996 | Brophy et al. | 52/609 X |
| 5,711,130 | 1/1998 | Shatley | 52/606 X |

FOREIGN PATENT DOCUMENTS

| | | |
|---|---|---|
| 900399 | 6/1945 | France . |

*Primary Examiner*—Christopher Kent
*Attorney, Agent, or Firm*—Michael R. Swartz; John R. Flanagan

[57] ABSTRACT

A building construction block includes a body made of a rigid material and having a substantially rectangular-shaped main portion, a wedge-shaped offset portion formed integral with the main portion, a pair of opposite side surfaces, a bottom surface, a top surface, a front surface and a rear surface. The top surface and opposite side surfaces are defined on both the main and offset portions. The rear and bottom surfaces are defined on the main portion. The front surface is defined on the offset portion and extends in a generally inclined direction from the bottom surface to the top surface and away from the rear surface. A first part of the top surface on the main portion receives and supports a first building component over the main portion, while a second part of the top surface on the offset portion receives and supports a second building component over the offset portion. The body preferably has a pair of side grooves each formed in one of the opposite side surfaces and disposed between the main portion and the offset portion. The side grooves are provided for guiding placement and alignment of the first building component on the top surface over the main portion of the body. The body may alternatively have a top groove formed in the top surface between the main and offset portions of the body. The top groove is provided for guiding placement and alignment of the first building component on the top surface over the main portion of the body.

23 Claims, 5 Drawing Sheets

CONCRETE BLOCK WITH OFFSET LEDGE AND INSTALLATION GUIDE MEANS

BACKGROUND OF THE INVENTION

1. Field of the Invention

The present invention generally relates to blocks for use in building construction and, more particularly, is concerned with a concrete block with offset ledge and installation guide means.

2. Description of the Prior Art

The construction of a building utilizing a horizontal slab, such as a basement or garage floor, and vertical walls requires the installation of a foundation which oftentimes is constructed of a multiplicity of building blocks, commonly called "cement or concrete" blocks, and a quantity of mortar placed between them. Ordinarily, a suitable guide string is employed to ensure that the building blocks are properly laid in horizontal and vertical alignment. Furthermore, some building walls are provided with an outside brick veneer.

One typical prior art building construction shown in FIG. 17 requires the use of building blocks, generally designated B, of different sizes (widths) in the construction of the foundation and wall. For example, the upper building blocks U used in an upper wall UW lying adjacent to an outside brick veneer G have the smallest size. The lower building blocks L used in the foundation F below the basement or garage floor slab S have the largest size. The middle blocks M located between the upper and lower building blocks U, L are smaller than the lower blocks L and larger than the upper blocks U. Building blocks U, L and M with these relative sizes will provide an interior offset IO for supporting an edge of the basement or garage floor slab S, and another, exterior, offset EO for supporting the outside vertical brick veneer G.

A problem exists, however, with this prior art building construction. It requires the manufacture of blocks having more than one size which leads to a requirement to maintain a large and expensive inventory of different size blocks. Therefore, this approach to building construction using conventional building blocks of different sizes is not the most practical one for accomplishing the task at hand.

Consequently, a need still exists for an approach to building construction which provides a solution to the problem existing in the prior art without introducing any new problems in place thereof.

SUMMARY OF THE INVENTION

The present invention provides a building construction block and a building wall designed to satisfy the aforementioned need. The building construction block of the present invention provides a more practical and economical means of constructing a horizontal slab and vertical wall through the use of blocks of the same size which has the advantageous effects of reducing inventory cost and of simplifying slab and wall installation. The building construction block of the present invention does all of this by merely incorporating an offset for reception of an adjacent slab or wall and incorporating guide grooves for alignment with a conventional guide string.

Accordingly, the present invention is directed to a building construction block which comprises a body of rigid material having a substantially rectangular-shaped main portion and a substantially wedge-shaped offset portion formed integral with the main portion. The body also has a pair of opposite side surfaces, a bottom surface, a top surface, a front surface and a rear surface. The top surface and at least one of the opposite side surfaces are defined on both the main and offset portions. The rear and bottom surfaces are defined solely on the main portion. The front surface is defined solely on the offset portion and extends in a generally inclined direction from the bottom surface to the top surface and away from the rear surface. A first part of the top surface overlying the main portion of the body is adapted to receive and support a first building component upon the main portion. A second part of the top surface overlying the offset portion of the body is adapted to receive and support a second building component upon the offset portion. The first part of the top surface has a width greater than a width of the second part of the top surface.

The building construction block also has an installation guide means on at least one of the top surface and opposite side surfaces of the body for guiding placement and alignment of the first building component on the first part of the top surface over the main portion of the body and of a guide string which is conventionally used in vertically and horizontally aligning conventional building blocks one above and end-to-end with each other. The installation guide means is a pair of opposite side guide marks, such as in the form of a pair of opposite side grooves, in a preferred embodiment of the block, and is a top guide mark, such as in the form of a single top groove, in an alternative embodiment of the block. Each side groove is formed in one of the opposite side surfaces of the body and is disposed between the main portion and the offset portion thereof. The top groove is formed in the top surface of the body and is disposed between the main portion and the offset portion thereof.

Thus, the side grooves or top groove defined on the body of the building block enables a construction worker to accurately place and align the building blocks on top of one another in a desired horizontal and vertical alignment with one another. This is generally necessary because the worker usually will be working on the inside of the wall being constructed with the building construction blocks and the offset portion of the body would obstruct his view of those building blocks below the offset portion such that the worker would not otherwise be able to visually align the next building blocks to be placed above those below them.

The offset portion of the body of the building construction block further has an outer edge formed between the top surface and the inclined front surface and extending between the opposite vertical side surfaces. The outer edge is preferably blunt but may also be pointed. The offset portion preferably extends from one side of the main portion. The offset portion may also extend from adjacent sides of the main portion so as to form a corner building construction block.

The present invention is also directed to a building wall which includes a plurality of first building components, a plurality of second building components, and at least one building construction block of the present invention as described above. The body of the building construction block at its bottom surface contacts and rests upon one of the plurality of first building components under the main portion of the body. The top surface of the body of the building construction block receives and supports another one of the plurality of first building components over the main portion and one of the plurality of second building components over the offset portion of the body. In this embodiment, the plurality of first building components have substantially the same size as one another. The plurality of second building components also have substantially the same size as one another and may form a horizontal slab, such as a garage floor, or a vertical wall, such as a brick veneer. The building wall thus constructed using the building construction blocks of the present invention does not require the use of conventional building blocks above or below them having more than one size.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
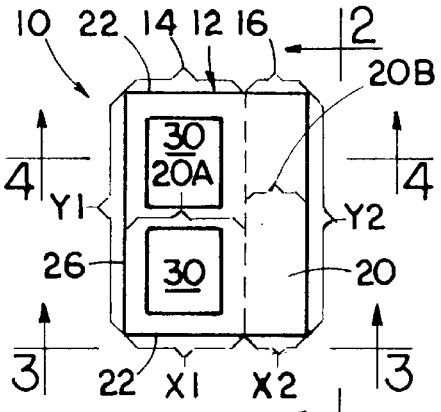
FIG. 1 is a top plan view of a building construction block of the present invention having an offset portion of a first predetermined size.
Figure 2:
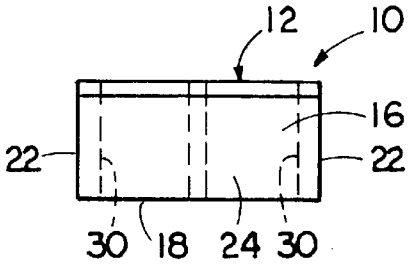
FIG. 2 is a front elevational view of the block as seen along line 2—2 of FIG. 1.
Figure 3:
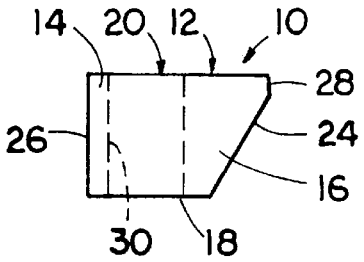
FIG. 3 is a side elevational view of the block as seen along line 3—3 of FIG. 1.
Figure 4:
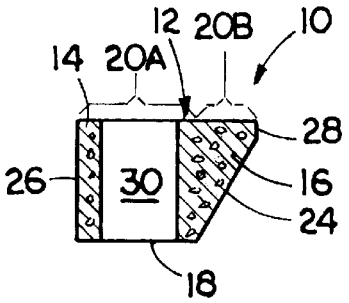
FIG. 4 is a cross-sectional view of the block taken along line 4—4 of FIG. 1.
Figure 5:
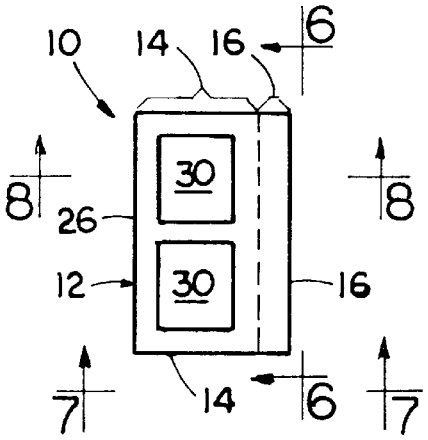
FIG. 5 is a top plan view of another building construction block of the present invention having an offset portion of a second predetermined size smaller than the first predetermined size of the block of FIG. 1.
Figure 6:
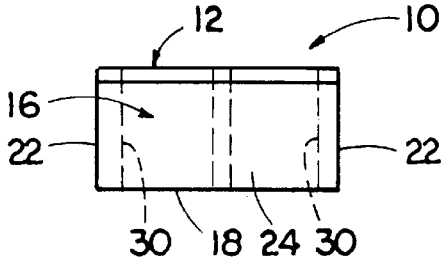
FIG. 6 is a front elevational view of the block as seen along line 6—6 of FIG. 5.
Figure 7:
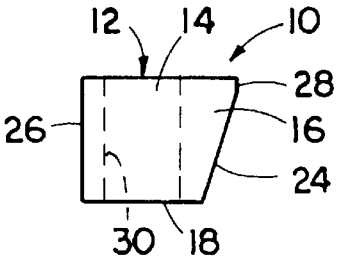
FIG. 7 is a side elevational view of the block as seen along line 7—7 of FIG. 5.
Figure 8:
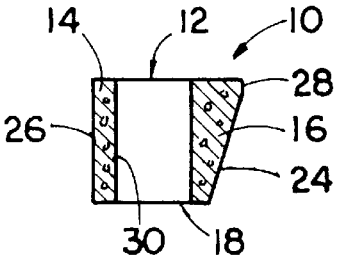
FIG. 8 is a cross-sectional view of the block taken along line 8—8 of FIG. 5.
Figure 9:
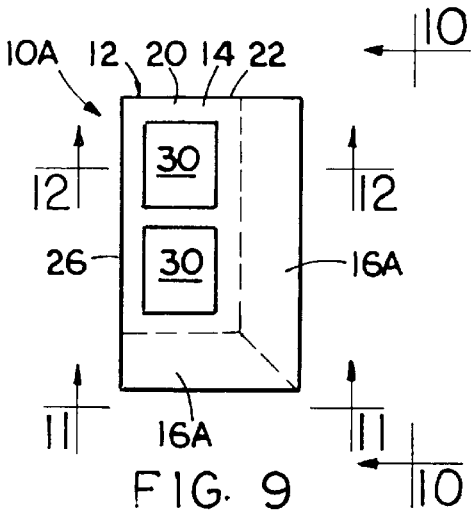
FIG. 9 is a top plan view of a corner building construction block of the present invention having an offset on two adjacent sides of the block.
Figure 10:
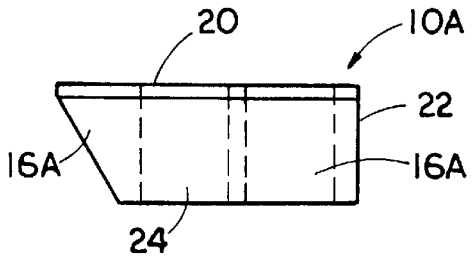
FIG. 10 is one side elevational view of the corner block as seen along line 10—10 of FIG. 9.
Figure 11:
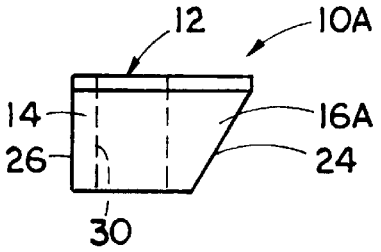
FIG. 11 is another side elevational view of the corner block as seen along line 11—11 of FIG. 9.
Figure 12:
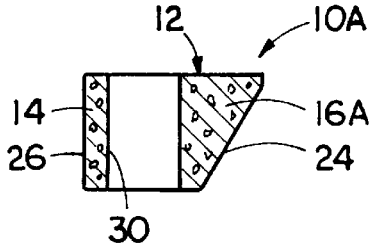
FIG. 12 is a cross-sectional view of the corner block taken along line 12—12 of FIG. 9.

In the following description, like reference characters designate like or corresponding parts throughout the several views. Also in the following description, it is to be understood that such terms as "forward", "horizontal", "left", "upwardly" and the like, are words of convenience and are not to be construed as limiting terms.

Referring to the drawings and particularly to FIGS. 1 to 8, there is illustrated a building construction block, generally designated 10, of the present invention. Basically, the block 10 includes a body 12 having a main portion 14 of substantially rectangular shape and an offset portion 16 of substantially wedge or triangular shape formed integral with the main portion 14 and projecting outwardly therefrom. The body 12 also has a bottom surface 18, a top surface 20 opposite from the bottom surface 18, a pair of opposite side surfaces 22 extending between the bottom and top surfaces 18, 20, and opposite front and rear surfaces 24, 26 extending between the bottom and top surfaces 18, 20 and between the opposite side surfaces 22. The opposite side surfaces 22 and top surface 20 of the body 12 are defined on both the main and offset portions 14, 16 of the body 12. The bottom surface 18 and rear surface 26 of the body 12 are defined solely on the main portion 14 of the body 12. The front surface 24 of the body 12 is defined solely on the offset portion 16 of the body 12 and extends in a generally inclined direction from the bottom surface 18 to the top surface 20 and away from the rear surface 26. In addition to the inclined front surface 24, the offset portion 16 of the body 12 has an outer edge 28 extending between the edges of the front surface 24 and top surface 20 and between the opposite side surfaces 22. The outer edge 28 preferably is in the form of a relatively low vertical wall extending substantially parallel to the opposite rear surface so as to present a blunt, as opposed to a pointed, tip on the offset portion 16. The top surface 20 has a first part 20A overlying the main portion 14 of the body 12 which is adapted to receive and support first building components, such as prior art building blocks B, upon the main portion 14 of the body 12. The top surface 20 further has a second part 20B overlying the offset portion 16 of the body 12 which is adapted to receive and support second building components, such as prior art bricks G, upon the offset portion 16 of the body 12. In their orientation during normal use, the bottom and top surfaces 18, 20 of the body 12 will lie in horizontal planes, whereas its opposite side surfaces 22 and rear surface 26 will lie in vertical planes.

The building construction block 10 is generally comprised of a substantially rigid material such as concrete, but can be made of any other suitable material. The block 10 may have any of the possible standard sizes, such as 6×8×16, 8×8×16, 10×8×16, or 12×8×16 inches, or any suitable variation thereof. The block 10 may have one or more cavities 30 of any shape and size or may be completely solid. Preferably, for reducing the weight, block 10 is provided with a pair of spaced apart cavities 30 with each cavity extending substantially vertically through the main portion 14 of the body 12, from the top surface 20 to the bottom surface 18, as best illustrated in FIGS. 1–8. For strength and integrity, the cavity or cavities 30 only extend through the main portion 14 of the body 12 and do not extend through the offset portion 16 of the body 12 which is formed integral with the main body portion. The main portion 14 of the body 12 is substantially greater in size in terms of its mass and volume than the offset portion 16 of the body 12. The first part 20A of the top surface 20 has a width X1 longer than a width X2 of the second part 20B of the top surface 20. Further, the first part 20A of the top surface 20 has a length Y1 that is substantially the same as a length Y2 of the second part 20B of the top surface 20. For example, the first part 20A of the top surface 20 on the main portion 14 may have a width of eight inches while the second part 20B of the top surface 20 on the offset portion 16 may have a width of four inches, as shown particularly in FIGS. 1–4, or a width of two inches, as shown particularly in FIGS. 5–8. The main portion 14 and the offset portion 16 may also have any other suitable sizes. Thus, the width of the second part 20B of the top surface 20 of the body 12 is preferably between about one-fourth to one-half of the width of the first part 20A of the top surface 20 thereof.

Referring to FIGS. 9–12, while the offset portion 16 preferably extends in only one direction from one side of the main portion 14 as shown in FIGS. 1–8, the offset portion 16 may extend in two directions from two adjacent sides of the main portion 14 being angularly displaced from one another by 90°. Therefore, the offset portion 16 can have a substantially L-shaped configuration when viewed from above as shown particularly in FIGS. 9–12. The building construction block having an offset portion 16A in this substantially L-shaped configuration is called a corner block 10A in view that it is readily suitable for use at a corner of a building construction. The offset portion 16A having the L-shaped configuration can receive the second building component G and a third building component (not shown) in an adjacent horizontal relation to the second building component.

Figure 15:
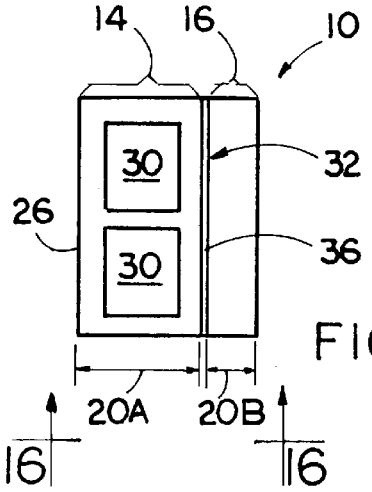
FIG. 15 is a top plan view of the building construction block of the present invention with an alternative embodiment of an installation guide means in the form of a top groove formed in a top surface of the block.
Figure 13:
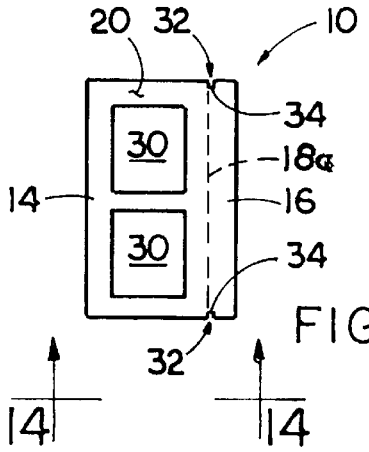
FIG. 13 is a top plan view of the building construction block of the present invention with a preferred embodiment of an installation guide means in the form of a pair of side grooves formed in opposite vertical side surfaces of the block.
Figure 16:
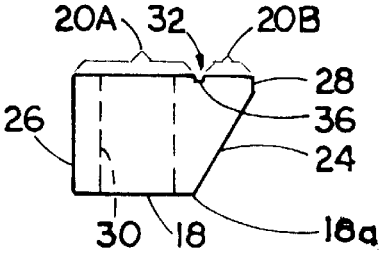
FIG. 16 is a side elevational view of the block as seen along line 16—16 of FIG. 15.
Figure 14:
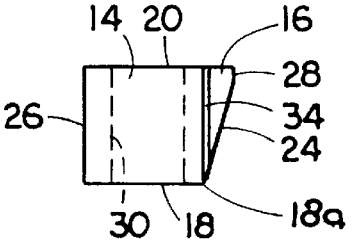
FIG. 14 is a side elevational view of the block as seen along line 14—14 of FIG. 13.

Referring to FIGS. 13–16, the building construction block 10 also includes installation guide means 32 placed on at least one of the top surface 20 or opposite side surfaces 22 of the body 12 for identifying the relative location of the lower front edge 18*a* of the body 12 formed by the meeting of the lower surface 18 with the front surface 24 of the body 12 so as to facilitate placement and alignment of one of the building blocks B, as seen in FIGS. 18 and 27–32, on the first part 20A of the top surface 20 over the main portion 14 of the body 12. Also, the installation guide means 32 can be used to guide placement and alignment of an elongated guide string Z for use in vertically and horizontally aligning the conventional building blocks B one above and end-to-end with each other. In a preferred embodiment shown in FIGS. 13 and 14, the installation guide means 32 is a pair of opposite side guide marks, such as in the form of a pair of opposite side grooves 34. Alternatively, in another embodiment shown in FIGS. 15 and 16, the installation guide means 32 is a top guide mark, such as in the form of a single top groove 36. As seen in FIGS. 13 and 14, each side groove 34 is formed in one of the opposite side surfaces 22 of the body 12 and is disposed between the main portion 14 and the offset portion 16 thereof. Each side groove 34 is substantially parallel to the rear surface 26 and serves as a visual projection of the location of the lower front edge 18*a* on the top surface 20 of block 10. As seen in FIGS. 15 and 16, the top groove 36 is formed in the top surface 20 of the body 12 and is disposed between the main portion 14 and the offset portion 16 thereof. The top groove 36 is substantially parallel to the rear surface 26 and located from the rear surface 26 approximately the same distance as the front lower edge 18*a* is located from the rear surface 26 and serves as a visual projection of the location of the lower front edge 18*a* on the top surface 20 of block 10. While the side and top guide marks are illustrated in the exemplary forms as grooves 34, 36 formed into the body 12, they may also take other suitable forms, such as painted marks and the like. Also, the grooves 34, 36 preferably have a straight configuration and extend continuously between the opposite edges of the top surface 20 and the opposite side surfaces 22 although they may also be discontinuous.

Thus, the side grooves 34 or top groove 36 defined on the body 12 of the building block 10 enable a construction worker to accurately place and align the conventional building blocks B on top of one another in a desired horizontal and vertical alignment with one another. This is generally necessary because, as can be understood with reference to FIG. 18, the worker usually will be working on the inside of the building wall 38 being constructed. At such position, the building construction block 10 and the offset portion 16 of the body 12 thereof would obstruct his view of those building blocks B below the offset portion 16 such that the worker would not otherwise be able to visually align the next building blocks B to be placed above those below them.

Figure 17:
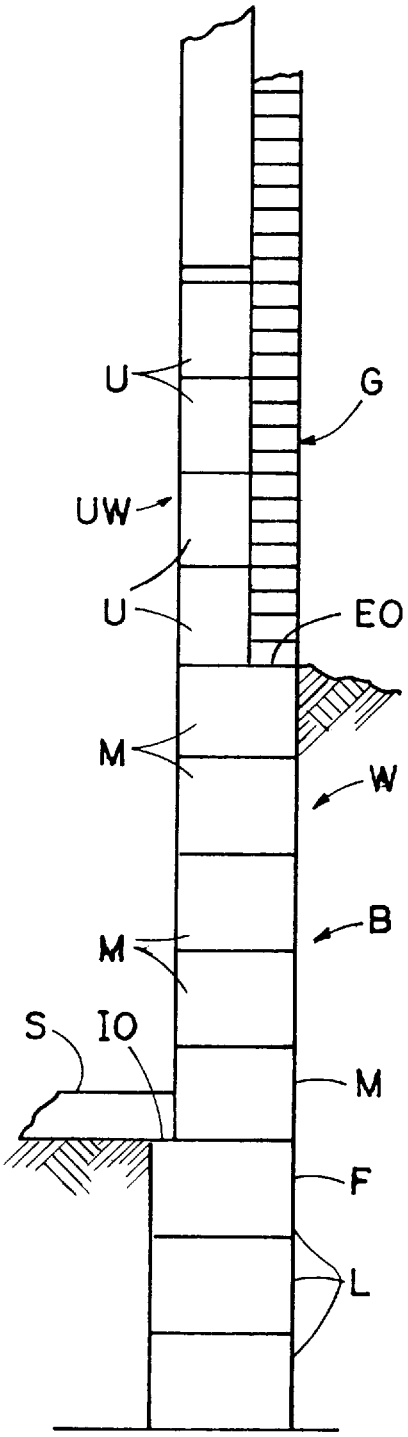
FIG. 17 (PRIOR ART)
FIG. 17 is a side elevational view of a prior art building wall construction utilizing building blocks of different sizes.
Figure 18:
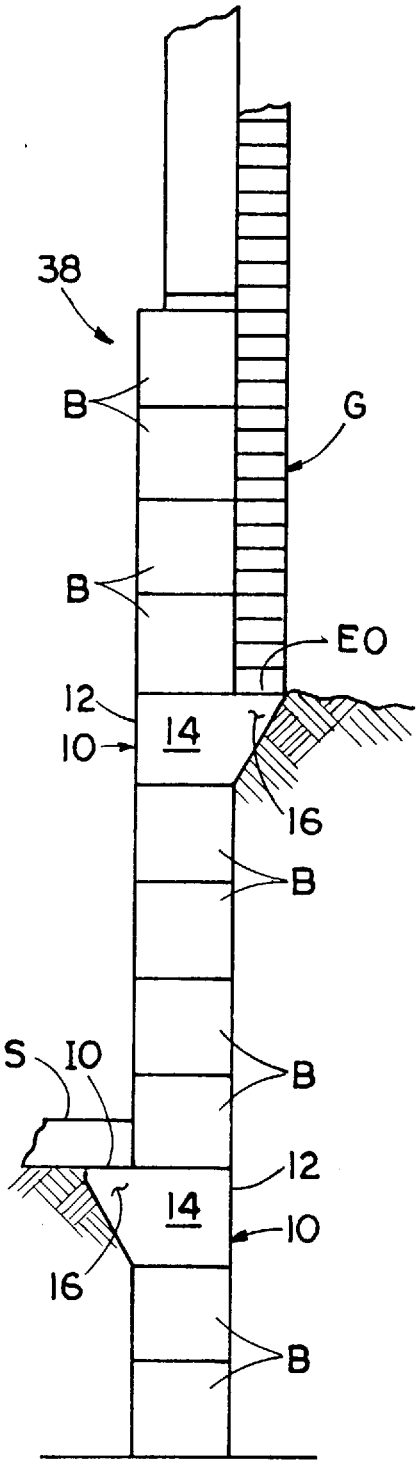
FIG. 18 is a side elevational view of a building wall construction of the present invention utilizing the building construction blocks of the present invention.

Referring now to FIGS. 17 and 18, a comparison of one prior art building wall W and the building wall 38 of the present invention can be easily made so as to better appreciate the advantages fostered by the use of the building construction blocks 10 of the present invention. Referring to FIG. 17, the prior art building wall W involves the use of different sizes of conventional building blocks B, such as the upper, lower and middle blocks U, L, M. The upper blocks U have the smallest size, such as 6×8×16 inches. The lower blocks L have the largest size, such as 12×8×16 inches. The middle blocks M have a size less than the lower blocks L and greater than the upper blocks U, such as 10×8×16 inches. The blocks U, L and M together provide the interior offset IO for the horizontal slab S, such as a garage floor, and another, exterior, offset EO for the vertical wall G, such as a brick veneer.

Referring to FIG. 18, in contrast to the prior art building wall W, the building wall 38 of the present invention can be constructed with conventional building blocks B having only one size by using the above-described building construction block 10 of the present invention to provide any interior and exterior offsets necessary to support other conventional building components, such as the horizontal slab S and the exterior brick veneer G. In the illustrated embodiment shown in FIG. 18, two building tiers or courses of construction blocks 10 of the present invention are used in conjunction with a plurality of conventional building blocks B and a plurality of bricks G to form the building wall 38. However, in its most elementary form, the building wall 38 of the present invention includes a plurality of first building components such as in the form of the plurality of conventional building blocks B and at least one of the blocks 10 of the present invention. The main portion 14 of the body 12 of the block 10 at its bottom surface 18 contacts and rests upon one of the building blocks B under the main portion 14 of the body 12. The main portion 14 of the body 12 of the block 10 at its first part 20A of the top surface 20 of the body 12 receives and supports another one of the building blocks B over the main portion 14 of the body 12. In addition, as shown in FIG. 18 the building wall 38 can include a plurality of second building components G such as the bricks making up the veneer. The lowest one of the plurality of second building segments G is received and supported on the offset portion 16 of the block 10. All of the building blocks B have the same size, such as 8×8×16 inches. All of the bricks of the veneer G also have the same size. The building wall 38 may incorporate a second block 10 supporting an edge of another building component such as in the form of the horizontal floor slab S.

Figure 19:
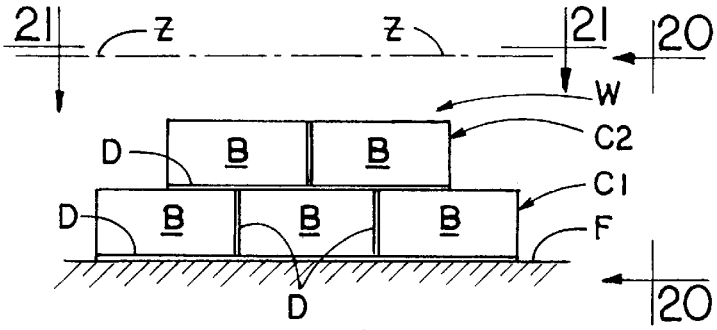
FIG. 19 is a diagrammatic front elevational view of a prior art wall of conventional building blocks under construction using a prior art process of laying the wall with employment of a guide string and after laying blocks in first and second courses of the wall.
Figure 20:
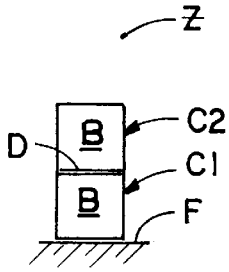
FIG. 20 is a diagrammatic end elevational view of the prior art wall as seen along line 20—20 of FIG. 19.
Figure 21:
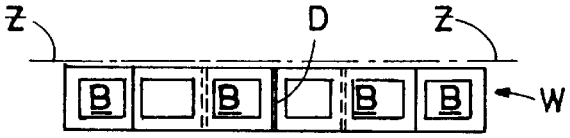
FIG. 21 is a diagrammatic top plan view of the prior art wall as seen along line 21—21 of FIG. 19.
Figure 22:
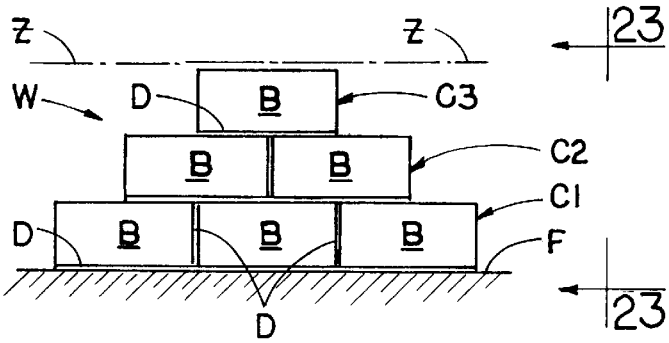
FIG. 22 is a diagrammatic front elevational view of the prior art wall of conventional building blocks after laying one block in a third course of the wall.
Figure 23:
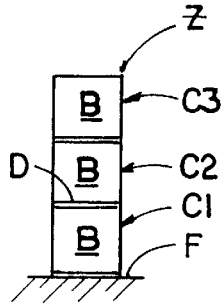
FIG. 23 is a diagrammatic end elevational view of the prior art wall as seen along line 23—23 of FIG. 22.
Figure 24:
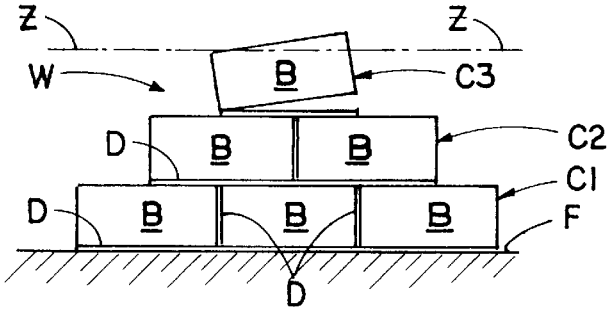
FIG. 24 is a diagrammatic front elevational view of a prior art wall similar to that of FIG. 22 but showing the block of the third course initially placed in an unleveled condition which can be easily corrected with employment of the guide string used in the prior art process of laying the wall.
Figure 25:
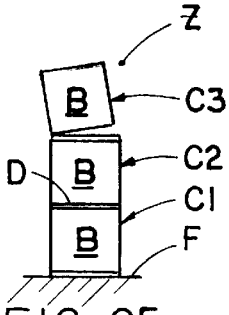
FIGS. 25 and 26 are diagrammatic end elevational views of the prior art wall similar to that of FIG. 23 but respectively showing the block of the third course initially placed in forwardly and rearwardly canted conditions which can be easily corrected with employment of the guide string used in the prior art process of laying the wall.
Figure 26:
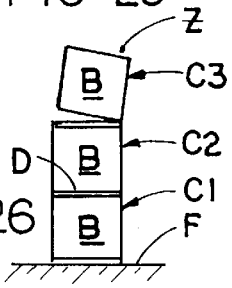

Referring now to FIGS. 19 to 26, there is illustrated a prior art process of laying a conventional block wall W made up of courses or horizontal rows of blocks B. FIGS. 19–21 show the wall W after laying blocks B in first and second courses C1, C2 of the wall. FIGS. 22 and 23 shown the wall W after laying one block in a third course C3 of the wall. There is a thin layer of mortar D applied between each of the blocks B. The guide string Z is employed to carry out the task of accurately laying the blocks B. The guide string Z is an alignment tool used in a manner well-known to one of ordinary skill in the art for laying the blocks B in a horizontally level and in a vertically plumb fashion. FIGS. 24 to 26 depict what could happen if the guide string Z is not employed to accurately lay the blocks B. FIG. 24 shows the block B not accurately leveled in a horizontal plane, while FIGS. 25 and 26 respectively show the block B in forwardly and rearwardly canted conditions relative to a vertical reference plane.

Figure 30:
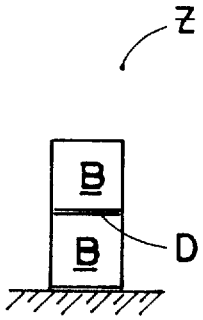
FIGS. 30 to 32 are diagrammatic end elevational views of a sequence of steps of a process of laying a building wall of the present invention using the building construction blocks of the present invention having the top groove in the top surface of the block.
Figure 31:
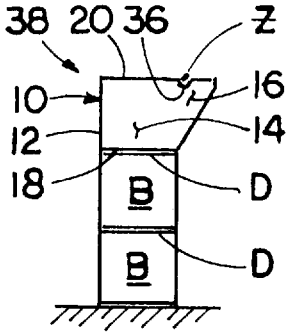
Figure 32:
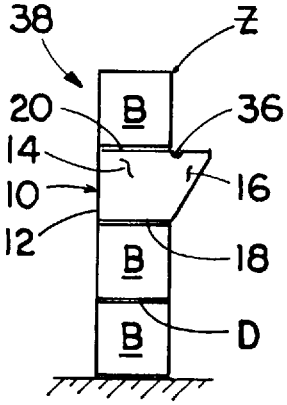
Figure 27:
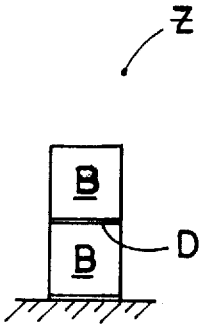
FIGS. 27 to 29 are diagrammatic end elevational views of a sequence of steps of a process of laying a building wall of the present invention using the building construction blocks of the present invention having the pair of side grooves in opposite side surfaces of the block.
Figure 28:
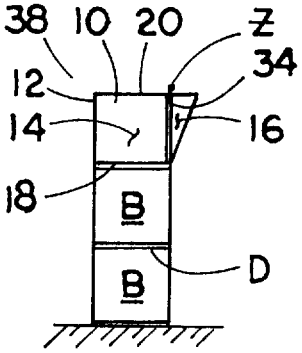
Figure 29:
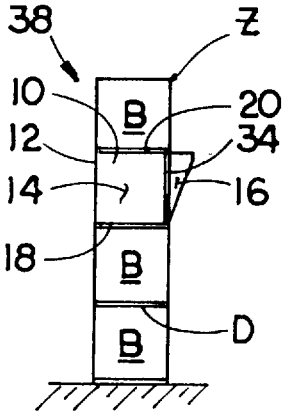

Referring now to FIGS. 27 to 32, there is illustrated the laying of the building wall 38 using the building construction blocks 10 of the present invention having the installation guide means 32. FIGS. 27 to 29 show the sequence of steps in laying the wall using a block 10 having the preferred embodiment of the installation guide means 32 in the form of the pair of side grooves 34 in the opposite side surfaces 22 of the block 10. FIGS. 30 to 32 show the sequence of steps in laying the wall using a block 10 having the alternative embodiment of the installation guide means 32 in the form of the top groove 36 in the top surface 20 of the block 10. The block 10 is laid upon one of the first building components being conventional building blocks B and the guide string Z is then disposed in a horizontal plane above the block 10 at a distance about equal to the height of a block plus a small additional distance to allow for the layer of mortar. The guide string Z also is disposed in a vertical plane aligned with the side grooves 34 or the top groove 36 depending upon which form of the installation guide means 30 is provided. Next, another building block-B is then laid upon the top surface 20 of the main portion 14 of the body 12 of the block 10 using the side grooves 34 or the top groove 36 for vertical alignment and horizontal leveling thereon.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

What is claimed is:

1. A building construction block, comprising:

(a) a body of rigid material having a substantially rectangular-shaped main portion and a substantially wedge-shaped offset portion formed integral with said main portion;

(b) said body also having a pair of opposite side surfaces, a bottom surface, a top surface, a front surface and a rear surface, said top surface and at least one of said pair of opposite vertical side surfaces being defined on both said main and offset portions, said rear and bottom surfaces being defined solely on said main portion, said front surface being defined solely on said offset portion and extending in a generally inclined direction from said bottom surface to said top surface and away from said rear surface;

(c) said top surface of said body having a first part overlying said main portion of said body being adapted to receive and support a first building component upon said main portion;

(d) said top surface of said body having a second part overlying said offset portion of said body being adapted to receive and support a second building component upon said offset portion, said first part of said top surface having a width greater than a width of said second part of said top surface, said width of said second part of said top surface being between about one-fourth to one-half of said width of said first part of said top surface; and (e) at least one cavity defined on said body and extending substantially vertically through only said main portion of said body from said top surface to said bottom surface.

2. The block as recited in claim 1, wherein said first part of said top surface has a length the same as a length of said second part of said top surface.

3. The block as recited in claim 1, wherein both of said pair of opposite vertical side surfaces of said body are defined on said main and offset portions thereof.

4. The block as recited in claim 1, wherein said body has an outer edge formed between said second part of said top surface and said front surface on said offset portion of said body, said outer edge being in the form of a relatively low vertical wall extending substantially parallel to said opposite rear surface of said body.

5. A building construction block, comprising:

(a) a body of rigid material having a substantially rectangular-shaped main portion and a substantially wedge-shaped offset portion formed integral with said main portion;

(b) said body also having a pair of opposite side surfaces, a bottom surface, a top surface, a front surface and a rear surface, said top surface and at least one of said pair of opposite vertical side surfaces being defined on both said main and offset portions, said rear and bottom surfaces being defined solely on said main portion, said front surface being defined solely on said offset portion and extending in a generally inclined direction from said bottom surface to said top surface and away from said rear surface;

(c) said top surface of said body having a first part overlying said main portion of said body being adapted to receive and support a first building component upon said main portion;

(d) said top surface of said body having a second part overlying said offset portion of said body being adapted to receive and support a second building component upon said offset portion, said first part of said top surface having a width longer than a width of said second part of said top surface; and (e) installation guide means defined on at least one of said top surface and said pair of opposite side surfaces of said body of said block for identifying the relative location of a lower front edge of said body formed by the meeting of said lower surface with said front surface of said body so as to facilitate placement and alignment of the first building component on said first part of said top surface over said main body portion.

6. The block as recited in claim 5, wherein said installation guide means is a pair of side grooves each formed in one of said pair of opposite vertical sides surfaces and disposed between said main and offset portions of said body.

7. The block as recited in claim 5, wherein said installation guide means is a top groove formed in said top surface and disposed between said main and offset portions thereof; said top groove being substantially parallel to said rear surface and located from said rear surface approximately the same distance as said front lower edge is located from said rear surface and serves as a visual projection of the location of said lower front edge on said top surface of said block.

8. A building construction block, comprising:

(a) a body of rigid material having a substantially rectangular-shaped main portion and a substantially wedge-shaped offset portion formed integral with said main portion;

(b) said body also having a pair of opposite side surfaces, a bottom surface, a top surface, a front surface and a rear surface, said top surface and at least one of said pair of opposite vertical side surfaces being defined on both said main and offset portions, said rear and bottom surfaces being defined solely on said main portion, said front surface being defined solely on said offset portion and extending in a generally inclined direction from said bottom surface to said top surface and away from said rear surface;

(c) said top surface of said body having a first part overlying said main portion of said body being adapted to receive and support a first building component upon said main portion;

(d) said top surface of said body having a second part overlying said offset portion of said body being adapted to receive and support a second building component upon said offset portion, said first part of said top surface having a width longer than a width of said second part of said top surface;

(e) said offset portion having an L-shaped corner configuration, one of said pair of opposite vertical side surfaces of said body being defined solely on said offset portion and extending in a generally inclined direction from said bottom surface to said top surface of said body and away from the other of said pair of opposite vertical side surfaces thereof.

9. A building construction block, comprising:

(a) a body of rigid material having a substantially rectangular-shaped main portion, a substantially wedge-shaped offset portion formed integral with said main portion, a bottom surface, a top surface on said main and offset portions of said body having a first part overlying said main portion of said body for receiving and supporting a first building component on said top surface over said main portion and a second part overlying said offset portion of said body for receiving and supporting a second building component on said top surface over said offset portion, and a pair of opposite side surfaces on said main and offset portions of said body extending between said bottom and top surfaces, thereof;

(b) said body further having installation guide means on said opposite side surfaces between said main portion and offset portion of said body and extending between said bottom and top surfaces thereof for guiding placement and alignment of the first building component on said first part of said top surface over said main portion of said body.

10. The block as recited in claim 9, wherein said installation guide means is a pair of side grooves each formed in one of said opposite side surfaces of said body.

11. The block as recited in claim 9, wherein said first part of said top surface has a width greater than a width of said second part of said top surface.

12. The block as recited in claim 11, wherein said width of said second part of said top surface of said body is between about one-fourth to one-half of said width of said first part of said top surface thereof.

13. The block as recited in claim 9, wherein said body includes:

a front surface defined on said offset portion and extending in a generally inclined direction from said bottom surface to said top surface and away from a rear surface located opposite from said front surface; and a blunt outer edge formed between said top surface and said front surface on said offset portion of said body.

14. A building construction block, comprising:

(a) a body of rigid material having a substantially rectangular-shaped main portion, a substantially wedge-shaped offset portion formed integral with said main portion, a bottom surface, a top surface on said main and offset portions of said body having a first part overlying said main portion of said body for receiving and supporting a first building component on said top surface over said main portion and a second part overlying said offset portion of said body for receiving and supporting a second building component on said top surface over said offset portion, and a pair of opposite side surfaces on said main and offset portions of said body extending between said bottom and top surfaces thereof;

(b) said body further having installation guide means on said top surface disposed between said first and second parts thereof and extending between said opposite side surfaces of said body for identifying the relative location of a lower front edge of said body formed by the meeting of said lower surface with said front surface of said body so as to facilitate placement and alignment of the first building component on said first part of said top surface over said main portion of said body, said installation guide means on said top surface being substantially parallel to said rear surface and located from said rear surface approximately the same distance as said front lower edge is located from said rear surface and serves as a visual projection of the location of said lower front edge on said top surface of said block.

15. The block as recited in claim 14, wherein said installation guide means is a top groove formed in said top surface of said body and disposed between said first and second parts of said top surface.

16. The block as recited in claim 14, wherein said first part of said top surface has a width greater than a width of said second part of said top surface with said width of said second part being between about one-fourth to one-half of said width of said first part.

17. A building wall, comprising:

(a) a plurality of first building components; and (b) at least one building construction block, said building construction block including (i) a body of rigid material having a substantially rectangular-shaped main portion and a substantially wedge-shaped offset portion formed integral with said main portion, (ii) a top surface on said main and offset portions of said body having a first part defined on and overlying said main portion of said body and receiving and supporting one of said first building components on said top surface over said main portion and a second part defined on and overlying said offset portion of said body for receiving and supporting a plurality of second building components on said top surface over said offset portion, (iii) a bottom surface on said main portion of said body contacting and overlying another one of said first building components under said main portion of said body such that said building block and said one of said first building components are supported above said another one of said first building components, (iv) a pair of opposite side surfaces on said main and offset portions of said body extending between said bottom and top surfaces thereof, and (v) at least one cavity defined on said body and extending substantially vertically through only said main body portion of said body from said top surface to said bottom surface.

18. The wall as recited in claim 17, wherein said body further has an installation guide means defined on at least one of said top surface and said pair of opposite side surfaces of said body of said block for identifying the relative location of a lower front edge of said body formed by the meeting of said lower surface with said front surface of said body so as to facilitate placement and alignment of the first building component on said first part of said top surface over said main portion of said body.

19. The wall as recited in claim 18, wherein said installation guide means is a pair of side grooves each formed in one of said opposite side surfaces and disposed between said main and offset portions of said body.

20. The wall as recited in claim 18, wherein said installation guide means is a top groove formed in said top surface and disposed between said main and offset portions thereof; said top groove being substantially parallel to said rear surface and located from said rear surface approximately the same distance as said front lower edge is located from said rear surface and serves as a visual projection of the location of said lower front edge on said top surface of said block.

21. The wall as recited in claim 17, wherein each of said plurality of first building components has substantially the same size.

22. The wall as recited in claim 17, further comprising:

(c) a plurality of second building components received and supported one above another on said second part of said top surface of said offset portion of said body over said offset portion.

23. The wall as recited in claim 17, further comprising:

(c) said offset portion of said body of said building construction block being substantially L-shaped when viewed from above and extending from and about two adjacent sides of said main portion of said body of said block and receiving second building components over said offset portion of said body of said block in adjacent horizontal relation to one another.

* * * * *